United States Patent [19]

Kattis

[11] 4,048,815

[45] Sept. 20, 1977

[54] FLAKE ICE MAKER

[76] Inventor: Theodore Kattis, 1315 Estes St., Lakewood, Colo. 80215

[21] Appl. No.: 626,363

[22] Filed: Oct. 28, 1975

Related U.S. Application Data

[62] Division of Ser. No. 502,031, Aug. 30, 1974, Pat. No. 3,921,415.

[51] Int. Cl.[2] ..... F25C 1/14

[52] U.S. Cl. ..... 62/354; 165/94

[58] Field of Search ..... 62/354, 320; 165/94

[56] References Cited

U.S. PATENT DOCUMENTS

| | | | |
|---|---|---|---|
| 3,049,895 | 8/1962 | Larson et al. | 62/354 |
| 3,159,010 | 12/1964 | Kattis | 62/354 |
| 3,214,935 | 11/1965 | Conto | 62/354 |
| 3,220,215 | 11/1965 | Pichler | 62/354 |
| 3,342,040 | 9/1967 | Dericks et al. | 62/354 |
| 3,501,927 | 3/1970 | Wadsack | 62/354 |
| 3,593,539 | 7/1971 | Fiedler | 62/354 |
| 3,630,045 | 12/1971 | Lunde | 62/354 |
| 3,643,454 | 2/1972 | Turner | 62/354 |
| 3,686,890 | 8/1972 | Lyman | 62/354 |
| 3,744,679 | 7/1973 | Nitschneider et al. | 62/354 |
| 3,820,354 | 6/1974 | Kohl et al. | 62/354 |
| 3,921,415 | 11/1975 | Kattis | 62/354 |

*Primary Examiner*—John J. Camby
*Assistant Examiner*—Henry C. Yuen

[57] ABSTRACT

A flake ice making machine having a stationary, vertical freezer cylinder disposed in a water tank having outwardly sloped sides, a rotary member to fracture ice flakes from ice frozen on the cylinder and an upwardly directed discharge chute where ice flakes dry and are discharged by more flakes pushing the flakes up the chute. Each rotating fracturing member includes a rearwardly sloped face extending from each fracturing edge which is located on the axial center line of the cylinder and each member flares outwardly from its bottom providing a constant clearance with the inner wall of the tank. To prevent the ice from moving back down the chute after the passage of the rotating members, obstruction from the chute floor prevents such back sliding.

4 Claims, 7 Drawing Figures

FLAKE ICE MAKER

This application includes the disclosures of the invention of Patent Office Disclosure Document Program No. 030358, dated Apr. 11, 1974, and No. 032051, dated May 13, 1974. This application is a division of Ser. No. 502,031, filed 8/30/74 and now U.S. Pat. No. 3,921,415.

PRIOR ART

Flake ice making machines are established mechanisms in beverage machines, restaurants, bars, homes and the like. Such machines form flakes of ice of various size, depending upon the operating parameters of the particular flake machine and the ambient conditions therearound. The mechanism for making flake ice is theoretically simple in its concept, but for a long operating life with little or no maintenance, the machine and its component parts present very difficult problems. Normally the machines for making flake ice include a cylindrical surface immersed in water on one side and having a refrigerant on the other side so as to form a thin sheet of ice on the water side. A revolving blade or blades remove the ice by flaking and the resultant flakes are permitted to float to the water surface. Some means are needed to elevate the flakes out of the water and into a storage receptacle. Thus, while the theory is simple, the many problems encountered make the machine difficult to produce for a long life operation and essentially maintenance free operation.

THE INVENTION

The present invention is an improvement of my U.S. Pat. No. 3,159,010, issued Dec. 1, 1964. The invention of that patent embodies a stationary, internally refrigerated surface immersed in a water tank which has an upwardly inclined ice chute for elevating the flakes out of the water before release to the storage bin. A rotary blade is provided for flaking the sheet of ice formed on the cylinder. The flakes of ice float to the surface of the water and are pushed up the chute by rotation of the flaking blade.

According to the present invention, I have provided a highly efficient flake ice machine having substantially reduced tendencies to clog or jam and thereby provide enhanced operating characteristics. The refrigerated cylinder is a vertical, internally refrigerated cylinder mounted in a stationary position in a water tank. The cylinder is a right cylinder, but the tank is provided with outwardly sloped internal walls permitting adequate space in the water for the floating flakes of ice pushed around the tank prior to movement up the discharge chute. The ice flaker consists of at least a pair of opposed blades, each provided with a rearwardly sloped face for forcing the floating free ice up the inclined chute for discharge. The blades include an ice fracturing edge located on the axial center line of the cylinder, but not contacting the cylinder. The individual blades only fracture a fraction of the axial length of ice on the cylinder, the fraction being relative to the number of members, so that ice which forms on any circumferential area forms and builds up during a complete revolution of the fracturing member which controls that portion of the cylinder area. Each blade therefore covers a fraction of the surface so that the total of all of the blades equals one, that is, with two blades, each covers one-half of the surface of the cylinder; with three blades, each covers one-third of the length of the surface area, etc., so that ice builds up for a complete revolution of the ice fracturing member of the area.

The water tank, in which the freezing cylinder is mounted, includes an outwardly sloped wall, i.e., flared outwardly at the top of the tank. The front profile of each blade is likewise flared outwardly to provide an essentially constant gap between the outer edge of the blade and the inner tank wall. This provides more volume at the top of the tank for collecting the ice flakes, and still maintains a minimum quantity of water in the tank for effective operation.

The blades include rearwardly slanted or trailing faces which help to force the floating ice flakes toward and up the inclined discharge chute. This provides an efficient gathering area for the floating ice without jamming and an effective pusher for the ice flakes up the inclined chute.

OBJECTS OF THE INVENTION

Included among the objects and advantages of the present invention is to provide a flake ice machine.

Another object of the invention is to provide a flake ice making machine having a flared water tank for gathering floating ice flakes without jamming and with a minimum amount of water.

Yet another object of the invention is to provide a flared water tank for flake ice making machines including outwardly flared flaking members rotating in the tank for effectively gathering floating ice and forcing the floating ice up a discharge chute.

Still another object of the invention is to provide a flaked ice making machine having ice fracturing members with rearwardly sloped faces for the effective movement of floating ice around the water holding tank and up an inclined outlet chute.

A still further object of the invention is to provide a flake ice making machine having fracturing members with their fracturing edges on the center line of the cylinder in an equidistant spacing around the cylinder, and provided with flat faces at 90° to the centerline of the freezing cylinder and not in contact therewith.

An additional object of the invention is to provide a flake ice making machine provided with more than one ice fracturing member, and each ice fracturing member having only a fraction of the length of the cylinder in relation to the number of fracturing members so that ice in any circumferential area of the cylinder forms for one full revolution of the breaker.

A further object of the invention is to provide a flake ice making machine having a discharge chute with retarders for the flake ice to reduce back sliding thereof in its discharge ascent of the chute.

A still further object of the invention is to provide a flake ice making machine having a freezing cylinder of enhanced and improved heat transfer qualities by treating the refrigerant contacting surface thereof for a higher heat transfer.

These and other objects and advantages of the invention may be readily ascertained by referring to the following description and appended illustrations in which.

SPECIFIC DESCRIPTION OF INVENTION

Figure 1:
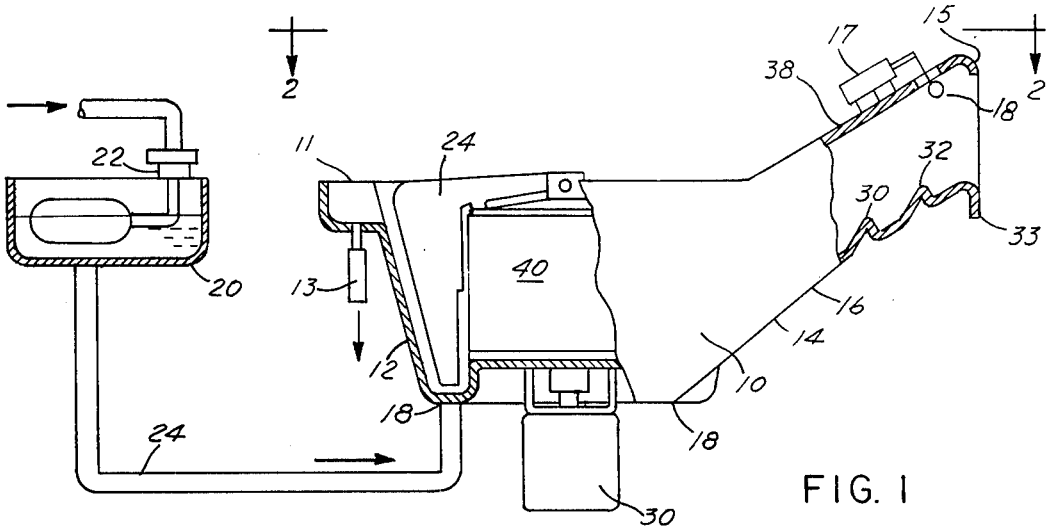
FIG. 1 is a partial cut-away, schematic side elevational view of a flaked ice making machine according to the invention.
Figure 2:
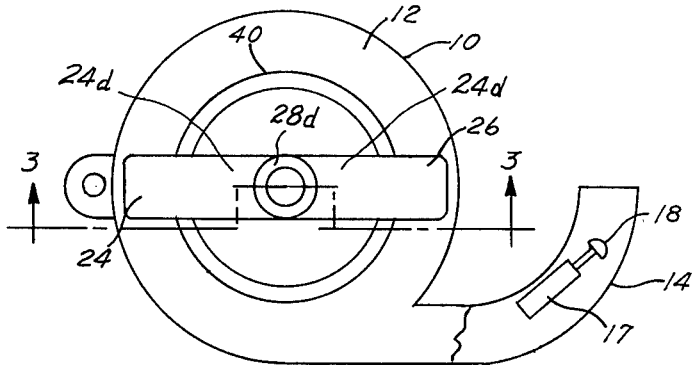
FIG. 2 is a top plan view of the machine of FIG. 1 taken along section lines 2—2.
Figure 3:
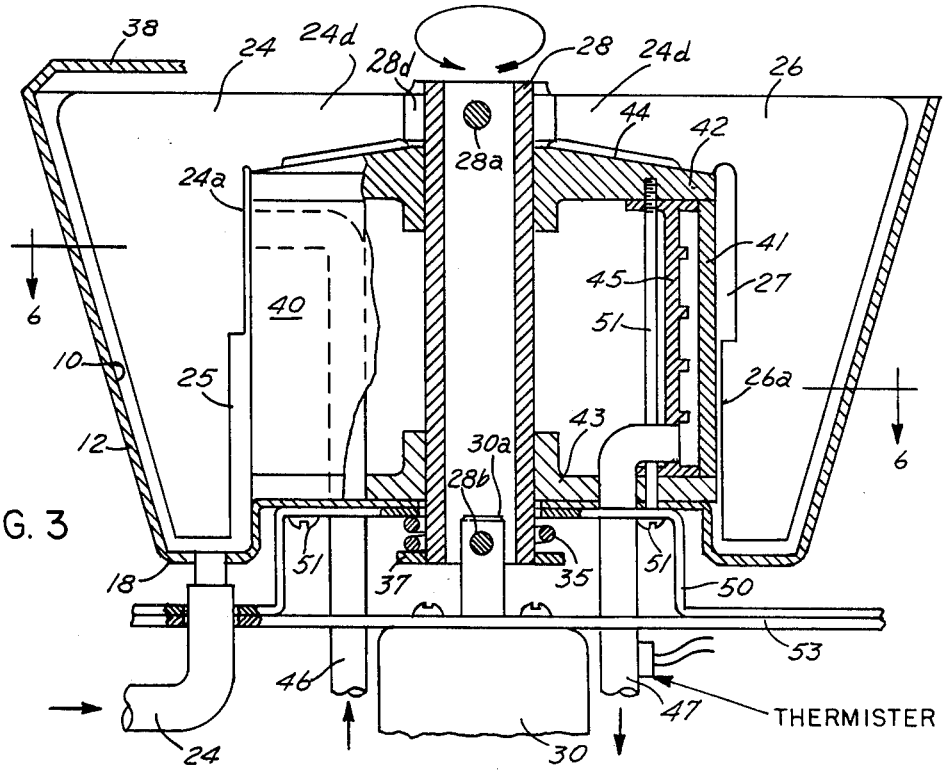
FIG. 3 is a cross-section elevational view of the device of FIG. 2.

The flaker of the invention is generally shown in FIG. 1, wherein a tank 10 having sloped sides 12 is provided with an upwardly directed outlet chute 14 having a bottom 16, which extends from about the bottom 18 of the tank 10 to an elevated discharge above the water level of the tank. The tank 10 is fed by a feed tank 20 having a float control valve 22 and connected by line 24 to the tank 10. The float control valve maintains a predetermined constant water level in the tank 10. An overflow 11 is incorporated in the tank 10. If the water level becomes higher than the predetermined level, the excess water will flow out the overflow tube 13. A pair of opposed flakers 24 and 26, by means of an integral, lateral bar, FIG. 3, is secured to a central shaft 28 extending upwardly from an electric gear head motor 30 through the tank 10 so as to rotate around the tank. The gear head motor rotates the flakers at approximately 2 R.P.M.

The discharge chute is provided with steps or raised portions 30 and 32 on the bottom to prevent the backslide of the ice going up the chute, as explained below, and it is provided with a lip 33 extending downwardly from the end of the chute. This provides for drippage of any water from the ice to fall straight downwardly where it can be collected, if desired, and prevents it from running down the chute to the bottom of the tank. Also, the steps or projections may be in the side walls of the chute for the same purpose. At the top of the chute 14 there is a downwardly extending lip 15 which will break up and force downward any long columns of ice which may form.

Mounted on the top 38 of the inclined chute 14 is a limit switch 17. The switch actuator 18 is located so that if the bin control (not shown) fails, the ice will pack up and cause pressure on the switch actuator 18 and will shut off the entire machine. This switch 17 can be of the manual or automatic reset type.

The shaft 28, shown at FIG. 3, is biased downwardly by means of a spring 35 bearing against a bottom portion of the tank and a ring 37 secured to the shaft. This prevents upward motion of the blades during their action of fracturing and the spring forces the ice removing blades downwardly. Further, as shown in FIG. 3, the shaft 28 is secured to a collar 28*d* from which a lateral bar 24*d* extends from opposite sides and blades 24 and 26 depend downwardly from the outer ends of the bar. The collar is secured to the shaft by means of a pin 28*a* and the motor shaft 30*a* is secured to the lower end of the shaft 28 by means of a pin 28*b*. As known in the art, the motor 30 may be placed below the unit or above the unit, depending upon the desires of the user and the space in which it will be mounted. A cover 38 fitting to the top of the tank 10 may be provided to provide the insulation for the tank from the upper side. The tank may be made of plastic, metal or the like and the cover 38 may, likewise, be made of a similar material.

A freezing cylinder 40 is mounted in the tank, and the cylinder is sealed to the tank to prevent leakage between the tank and the shaft. In this way, the water in the tank is in the form of an annular body having an upwardly sloped outer edge. The freezing cylinder is stationary in the tank and may be easily sealed to the tank, preventing leakage.

The cylinder 40 includes a tubular shell 41, made of a material of high thermal conductivity, such as brass, having a top closure 42 and a bottom closure 43. The closures, made of a material of low thermal conductivity and good bearing properties, such as plastic, are arranged to pass the rotatable shaft 28 for rotating the blades 24 and 26 around the tank. The top closure 42 has a conical shaped top 44 to drain off any water or moisture which may have a tendency to accumulate there. An inner shell or cylinder 45 is provided with an annular, generally sprial groove for the passage of refrigerant fluid from an inlet line 46 at the top to the outlet line 47 at the bottom. As shown, the inlet line 46 enters from the bottom of the cylinder to the top of the freezing unit, passing through the groove and along the outer shell to the outlet 47 at the bottom of the freezing cylinder detailed below.

To provide for mounting of the unit, a bracket 50 secured by means of screws 51 extending through the bottom of the tank in the bottom of the freezing unit secures to the top thereof as shown in FIG. 3. A series of these screws provide means for sealing the freezing cylinder onto the tank. The bracket 50 may be attached to any surface 53 in the cabinet of the ice unit, and the motor 30 may also be attached to the surface or flat member 53.

The flaking blades flare outwardly from the bottom toward the top to provide a constant clearance between their outer edge and the wall of the tank. Furthermore, with two opposed blades, they are arranged to flake only half of the axial length of the freezing cylinder and thus provide a breaking member for ice along only half of the cylinder length. As shown for two blades, the breaking edge 24*a* is provided on the blade 24 and a breaking edge 26*a* is provided on the blade 26. The breaking edge 24*a* is at the upper portion of the blade and therefore fractures only ice on the upper part of the cylinder. Thus, blade 24 is provided with a section 25 which is removed from the cylinder and will not provide breaking of the ice. The blade 26 is, also, provided with a section 27 which is spaced away from the edge of the surface of the cylinder to prevent breaking of ice built up on that portion of the cylinder.

The blades, having fracturing edges on a portion of their blade fracturing edge, make an equivalent of one blade having an edge fracturing the ice along the full length of the cylinder. Each section of the cylinder is only fractured once during a blade revolution. This permits an ice build-up of one complete revolution of that breaker portion for the area. The breaking edge 24*a* of blade 24 and the breaking edge 26*a* of the blade 26 are positioned on a center line passing through the freezing cylinder. The breaking edges 24*a*, 26*a* are approximately 0.010 inch from the freezing cylinder wall 40. The breaking edges fracture the ice off of the freezing cylinder down to the base metal of the cylinder. A refrigerator unit (not shown), as commonly used on ice making machines and known to those versed in the art, maintains the outer wall of the cylinder 40 at approximately 10° F.

Figure 6:
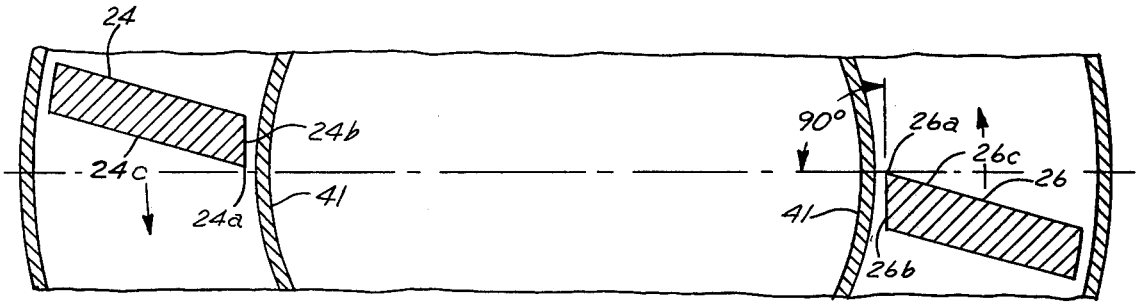
FIG. 6 is a fragmental view of a top plan of the flaker of the invention showing the fracturing members and their position in relation to a freezing cylinder.

As shown in FIG. 6, blade 24 includes a face 24b which extends rearwardly of the breaking edge 24a. Extending rearwardly from the breaking edge 24a, the face 24b is at 90° to the center line through the cylinder. In a similar manner, face 26b is 90° to the center line and that face extends rearwardly from the breaking edge. These faces 24b and 26b are substantially flat faces which have a tendency to easily ride over the freshly forming ice, following the breaker, to minimize any jerking effect of the blades during rotation of the blades around the cylinders. In addition to the face along the surface of the cylinder, each blade includes a trailing face fronting the floating ice; thus, blade 24 has a trailing face 24c which extends rearwardly from the breaking edge 24a considering the direction of travel. Likewise, face 26c extends rearwardly from the breaking edge 26a. These trailing faces help force the free ice up and into the inclined chute.

The tank and the blades rotating therein are flared outwardly from the bottom toward the top. The blades are provided with a clearance with the tank sides for free movement. The ice flakes which are removed from the freezing cylinder float upwardly to the top of the tank where more space is required to accommodate the flakes broken off during a complete revolution to prevent the packing of the ice as the blades push the ice flakes around the tank. The rearwardly extending faces aid in pushing ice up the chute and tend to hold the ice in the chute as the blade passes the entrance to the chute. Also, to prevent the ice from slipping back down the chute, the steps 30 and 32, or equivalent downward retarding members, are provided on the bottom or sides of the chute. Furthermore, two or more inclined chutes, spaced equi-angularly around the tank, may be provided for the discharge of ice from the chute. As the size of the ice maker increases, more chutes may be desired to prevent excessive packing of the ice which would occur with only one or two chutes. Further, to conserve space, the outlet of the chute may be curved rather than extending straight out. It is, of course, realized that the chute must be a certain length to retain the water in the tank and to hold the ice out of the water to provide for drainage of the water from the flaked ice.

Figure 4:
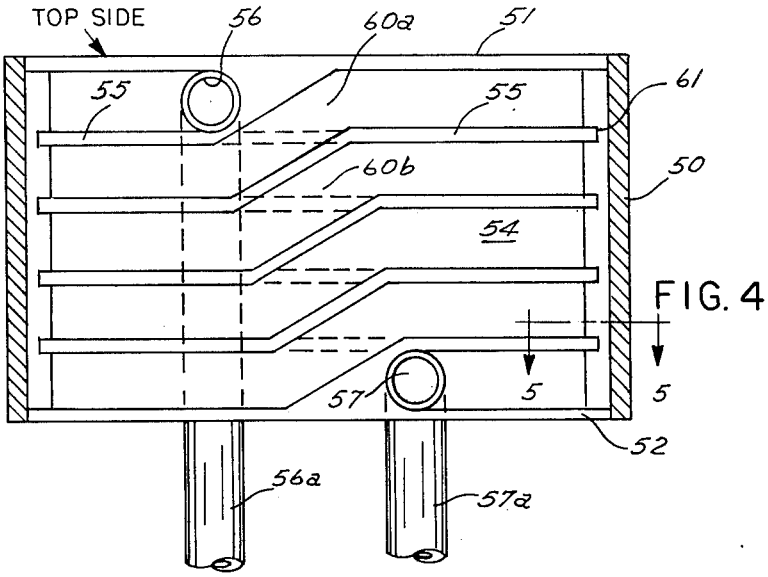
FIG. 4 is an enlarged view of a freezing cylinder according to the invention.
Figure 5:
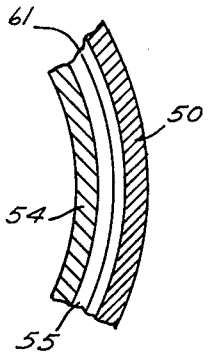
FIG. 5 is an enlarged detail view of the inner surface of a freezing cylinder showing the improved flow of refrigerant through the cylinder in contact with the inside surface of the freezing portion of the cylinder.

An effective freezing cylinder is shown in FIG. 4, wherein a tubular member 50 is provided with a top closure 51 and a bottom closure 52 enclosing the member for holding refrigerant. A central cylindrical member 54 is provided with a series of flanges 55 forming grooves which in effect spiral from inlet 56 of the inlet tube 56a down to the outlet 57 of the outlet tube 57a. That order may be reversed. The flange 55 extends generally at right angles to the axis of the cylinder. This forms a horizontal groove from the inlet to a point approximately 330° around the cylinder where the groove steps down 60a at about a 30° angle to form the next horizontal groove or passage below the inlet. This passage or groove then extends approximately 330° around the cylinder to the next level step down 60b which provides a passage to the next level, and the same procedure is followed down to the outlet 57. The flanges 55 are formed by milling a level groove around the inside cylinder with the connecting steps between layers to form the spiral arrangement from the outlet to the inlet. The groove may be made by casting or machining the same on the inner cylinder. The dog-leg or step grooves form a uniform refrigeration effect on the outer wall, leaving no dead spaces as would occur with a true spiral groove which, of course, leaves a dead space at the entrance and exit parts of the inner wall. A slight clearance 61 is provided between the flanges 55 of the grooves and the inner wall of the tubular member 50. This permits most of the refrigerant fluid to travel circumferentially around the grooves, but a small amount will travel vertically downwardly through the clearances between the flanges and the wall. This provides horizontal and vertical mixing of the fluid to create a turbulence which increases the heat transfer through the tubular wall 50. This increased heat transfer results in better refrigeration efficiency, and thus increases ice production. It also provides that the entire tube wall is a prime surface for the refrigerant fluid with no restrictions.

Figure 7:
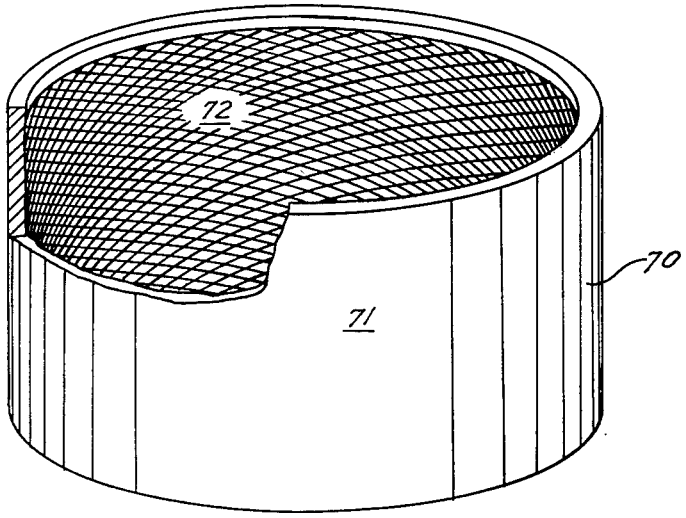
FIG. 7 is an enlarged schematic view of a hollow tube to be used as the freezing shell of an ice maker according to the invention showing the means for improved heat transfer.

To further enhance the heat transfer, a tubular member 70, shown at FIG. 7, includes an outside, smooth surface 71 and an inside surface 72 which is knurled or otherwise roughened to provide for a more effective heat transfer through the cylinder wall 70, from the refrigerant fluid, which will be on the inside of the tubular member, and water outside the cylinder. In some units, the sides may be reversed but the roughened surface for the refrigerant increases heat transfer.

A typical refrigerant system involves a compressor, condenser fan, dryer, automatic expansion valve, a heat exchanger and an accumulator. With an automatic expansion valve, the suction pressure on the refrigerant side will remain constant. For one set of conditions, assume that the inlet water to the tank is at 70° F. temperature, the surrounding air temperature (ambient) is 70° and the suction temperature is 10° F. with a 10° superheat at the outlet of the refrigerant line of the freezing cylinder. The water level of the water tank is maintained constant and the blade for chipping the ice remains at a constant r.p.m. Under this set of conditions, the ice buildup would be about 0.062 inches before it is fractured off by the blade. The resulting ice flakes under these conditions would be approximately the same thickness. However, if the ambient temperature and the water inlet temperature both increase to about 100° F., for example, the temperature at the cylinder outlet increases, for example, to about 30° F. and now the ice instead of being 0.062 inches thick will only be 0.032 inches thick. Also, there is now a 20° superheat at the outlet of the refrigerant line of the cylinder.

Under these conditions, it is known that the freezing cylinder (evaporator) will be starved. On the other hand, if the ambient and inlet water temperatures are reduced to 50° F., the ice flakes will be on the order of 0.125 inches thick and the evaporator would be flooded through with 0° superheat.

The inlet water temperature is normally close to ambient. However, the incoming water may be precooled, such as having the water line located adjacent the bottom of the ice storage bin where the ice or the melt water from the ice cools it down to a constant temperature, for example, 35° F. Even without this precooling, two methods are provided for maintaining the 0.062 inch thick flakes.

A gear head motor may be used to change the output speed of the breakers to thereby change the rate of rotation and the rate at which the ice is broken from the cylinder. Thus, the output speed of the motor would increase or decrease, as necessary, to constantly maintain a 10° superheat at the refrigerant line outlet of the cylinder. The speed may be changed by using a thermistor, as shown in FIG. 3, located on the outlet refrigerant line of the cylinder. For example, assume the output shaft of the gear motor rotates the ice fracturing blades at 2 r.p.m. at 70°-70°, inlet water temperature to ambient air temperature, and 10° superheat. As the ambient and superheat increases, the gear motor would slow down and at 100°-100°, inlet water temperature to ambient air temperature, would rotate the ice blades at 1 r.p.m. Conversely, as the ambient temperatures went down, the ice blades would be rotated faster, approximately, for example, 3 r.p.m. at 50°-50°, inlet water temperature to ambient air temperature. The motor speed would be directly controlled by the superheat which in turn is a function of the ambient temperatures.

In the second method, the ice removing gear motor is maintained at a constant rotation, for example, 2 r.p.m. at all times during the ice removal. The float valve assembly may be replaced by a motor driven water valve, which is a common control item, to change the water level of the tank of the unit. A valve of this type incorporates a motor, say, a permanent split capacitor type which then, when actuated, can modulate the flow of water through the valve from no flow to full flow. By maintaining a constant 10° superheat, as described above, the valve motor will admit water as required. For example, at 50°-50°, the water in the tank would be at the top of the freezing cylinder. At 70°-70°, it would be maintained about three-fourths of the way up and at 100°-100°, it will be at a distance of about half the length of the freezing cylinder from bottom to top.

While the invention has been described by reference to specific embodiments, there is no intent to limit the spirit or scope of the invention as defined in the claims.

What is claimed is:

1. In a flake ice maker having an annular water chamber with an inner and an outer wall for maintaining a predetermined water level therein, means for refigerating one of said walls producing a layer of ice, rotary flaking means for progressively breaking flakes from the layer of ice around the wall and chute-type discharge means for ice from the annular chamber, the improvement of switch means located in said discharge chute for actuation upon a predetermined pressure of accumulated ice flakes in said chute, said switch means arranged to shut off the flake ice maker on being activated.

2. In a flake ice maker having an annular water chamber with an inner and an outer wall for maintaining a predetermined water level therein, means for refrigerating one of said walls producing a layer of ice, rotary flaking means for progressively breaking ice flakes from the layer of ice around the wall and a closed chute-type discharge means for ice extending upwardly from the annular chamber to an ice discharge outlet at the top of the chute above the water level in the chamber, the improvement of a downwardly extending lip at said top of said discharge chute, said lip forcing downwardly exiting ice flakes, said lip being a short, downwardly directed extension of the top wall of the chute to break up existing columns of ice passing up the chute and force the same downwardly.

3. In a flake ice maker having an annular water chamber, a vertical freezing cylinder located substantially concentric in said chamber, rotary flaking means mounted in the annular chamber for progressively breaking ice flakes from the wall of said cylinder, sloped chute type discharge means for ice extending upwardly from near the bottom of the chamber to a discharge outlet above the level of water contained in said chamber, the improvement comprising a substantially conical member covering the top of said freezing cylinder permitting water to run off the top of the cylinder and prevent accumulation of water which could freeze.

4. In a flake ice maker having an annular water chamber with an inner and outer wall for maintaining a predetermined water level therein, means for refrigerating one of said walls producing a layer of ice, rotary flaking means mounted for rotation around the wall producing the layer of ice for progressively breaking ice flakes from the layer of ice on the wall and chute-type discharge means for ice extending upwardly from the annular chamber, the improvement of a compression spring resiliently biasing said rotary flaking means in a downward direction and concentric shaft means extends upwardly through said annular chamber and said rotary flaking means includes a lateral bar mounted on the upper end of said shaft means and flaking blades extend downwardly from said bar in contact with the wall having the layer of ice and said compression spring bears against said shaft means biasing the same downwardly in its flaking action.

* * * * *